US006005229A

United States Patent [19]

Brown et al.

[11] Patent Number: 6,005,229

[45] Date of Patent: Dec. 21, 1999

[54] COOKING OVEN INCLUDING A CONVECTION HEAT SOURCE AND A MICROWAVE HEAT SOURCE

[75] Inventors: Geoffrey John Edmund Brown, Cheshire; Terence Paul Williams, Birmingham; Gordon Andrews, Kent; David Brunton, Dyfed, all of United Kingdom

[73] Assignees: Stoves PLC, Prescot; BG PLC, London; Gama Consultants, Bromley; Apollo Enterprises Limited, Shirley, all of United Kingdom

[21] Appl. No.: 08/980,009

[22] Filed: Nov. 26, 1997

[30] Foreign Application Priority Data

Nov. 28, 1996 [GB] United Kingdom ..... 9624716

[51] Int. Cl.[6] ..... H05B 1/02

[52] U.S. Cl. ..... 219/483; 219/506; 219/412; 219/681; 99/325

[58] Field of Search ..... 219/506, 497, 219/411–413, 494, 681, 683; 99/325, 328, 330–333

[56] References Cited

FOREIGN PATENT DOCUMENTS 0 283 182 9/1988 European Pat. Off. .
0 374 397 6/1990 European Pat. Off. .

*Primary Examiner*—Mark Paschall
*Attorney, Agent, or Firm*—Jacobson, Price, Holman & Stern, PLLC

[57] ABSTRACT

A cooking oven comprises convection and microwave heat sources (not shown), controls 1 and 3,4 for presetting the temperature and cook time of the oven for a food item to he cooked therein, a further control 5 for selecting a reduced time cooking routine for the oven, and a microprocessor (not shown) responsive to the operation of the further control 5 for controlling the convection heat source and/or the microwave heat source in accordance with a reduced time cooking routine which is determined by the preset temperature and cook time (FIG. 1).

11 Claims, 2 Drawing Sheets

COOKING OVEN INCLUDING A CONVECTION HEAT SOURCE AND A MICROWAVE HEAT SOURCE

This invention relates to cooking appliances and relates more particularly to cooking ovens. It relates specifically to so-called combination ovens incorporating convection and microwave heat sources.

When using cooking ovens it has been found in general that users like to program an oven to cook a particular food item in accordance with temperature/time selections which are known from experience and used over a number a years or are set out in conventional cooking recipes. Combination ovens enable the advantages of both a convection oven and a microwave oven to be obtained, but their programming can be very complicated and off-putting to many users.

It is an object of the present invention to provide a cooking appliance in the form of a combination oven which is much easier to program than conventional combination ovens.

According to the present invention there is provided a cooking oven comprising convection and microwave heat sources, a control for presetting the temperature and cook time of said oven for a food item to be cooked therein, a further control for selecting a reduced time cooking routine for said oven, and a microprocessor responsive to the operation of said further control for controlling said convection heat source and/or said microwave heat source in accordance with a reduced time cooking routine which is determined by said preset temperature and cook time.

Advantageously, said microprocessor is effective during said reduced time cooking routine for controlling the temperature output and time of operation of said convection heat source and/or the microwave power output and time for operation of said microwave heat source.

In a preferred embodiment it will be arranged that said microprocessor is responsive to the further operation of said further control for controlling said convection heat source and/or said microwave heat source to modify said reduced time cooking routine.

Preferably a display will be provided for displaying the cook time preset in said oven and the cook time determined by said microprocessor.

Figure 1:
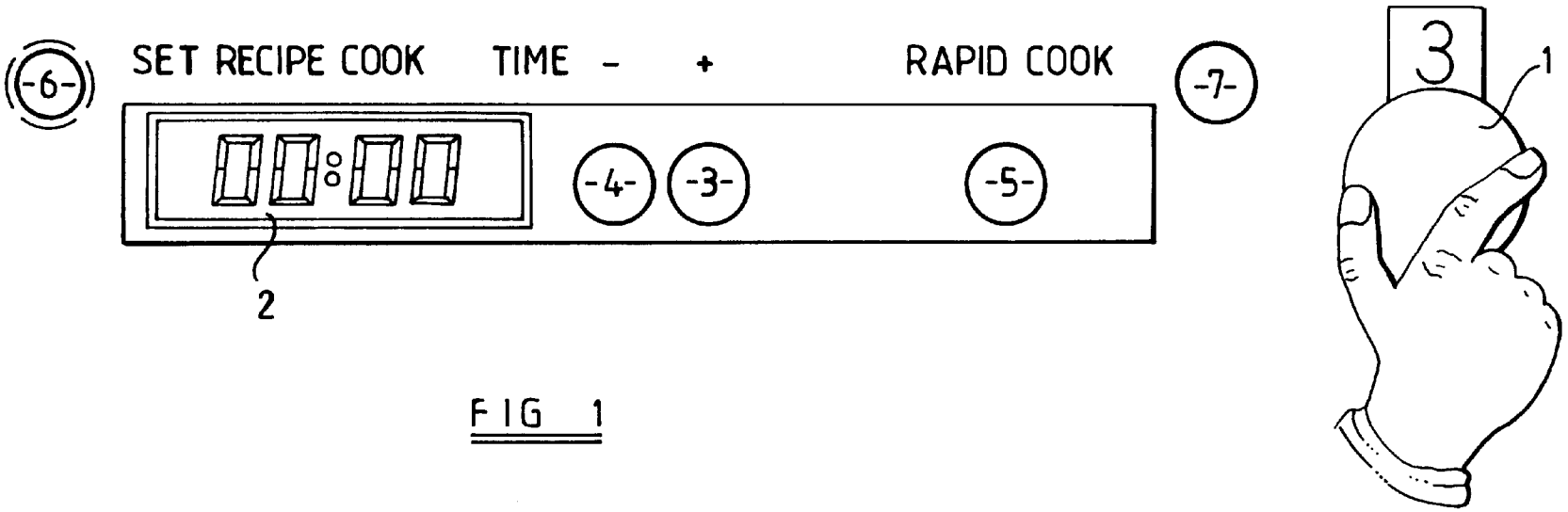
Figure 2:
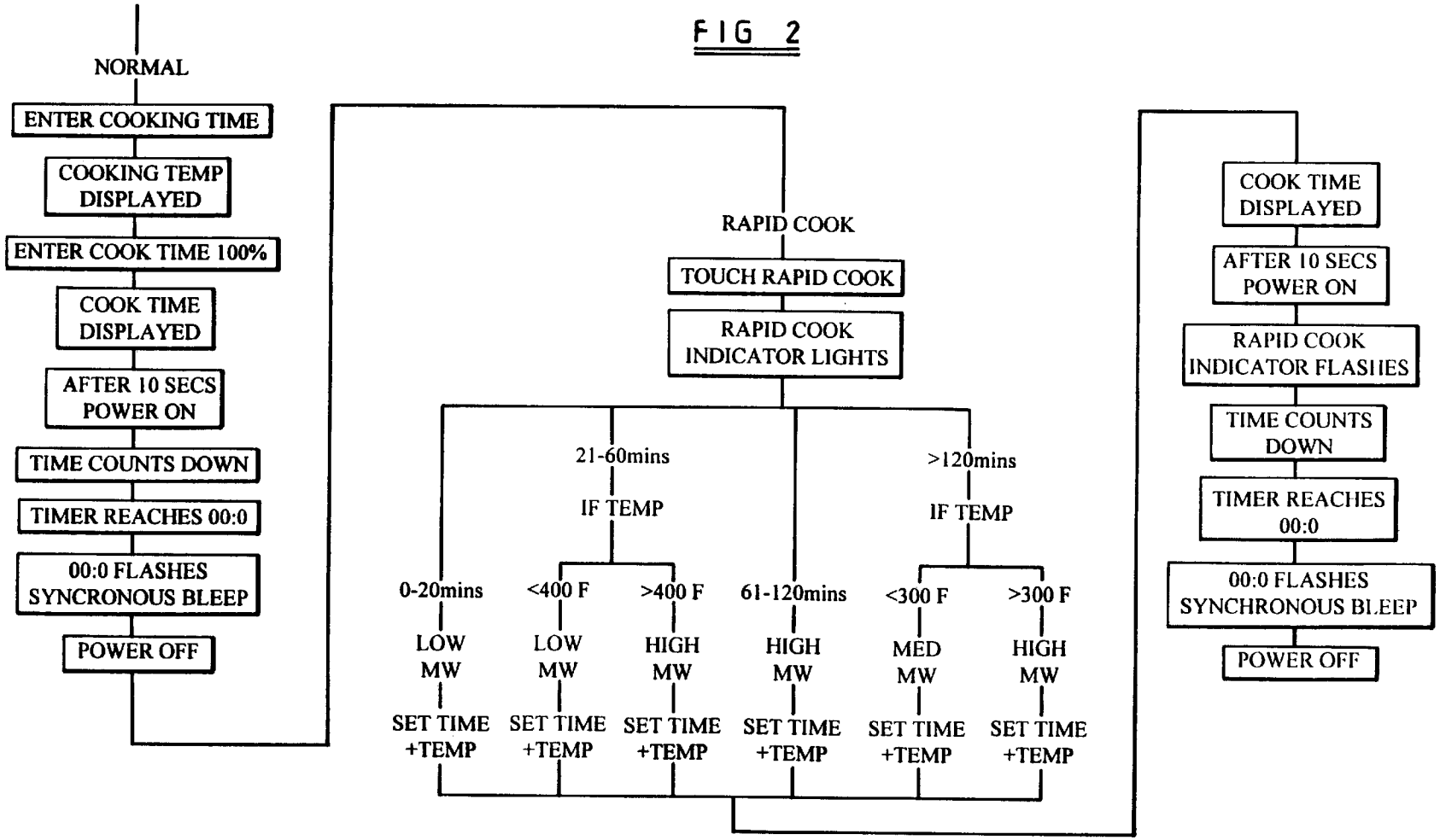

An exemplary embodiment of the invention will now be described, reference being made to the accompanying drawings, in which:

FIG. 1, is a front view of a typical control panel of a cooking oven according to the present invention; and FIG. 2, depicts a typical microprocessor control program for use in a cooking oven according to the present invention.

The present invention is based on the appreciation that the temperature and cook time which a user presets into an oven to cook a food item using conventional e.g. non-microwave cooking recipes are indicative of the actual food item being cooked and can be used in a combination oven to control the cooking routine in order to maximise the use of the oven and to reduce considerably the cook time, for example by a least half.

In FIG. 1 there is depicted a typical control panel of a combination gas cooking oven (not shown) in accordance with the present invention. The control panels consists of a thermostatic gas control 1 for manually setting the temperature of the oven, a digital display 2 for displaying the time of day, cook time, etc., of the oven, plus (+) and minus (–) push button controls 3 and 4 for setting a required cook time on the display 2 and a "rapid cook" push button control 5 the function of which will be described.

To operate an oven incorporating the control panel of FIG. 1, the thermostatic gas control 1 is set to the required mark setting and normal cook time is set into the display 2 using the + and – controls 3 and 4. If no other action is taken the oven operates in its "normal" mode and causes a "normal" light 6 to be lit. The oven then operates at the required temperature for the set cook time, which will be counted down on the display 2, after which time an alarm will sound to indicate completion of the cook time.

However, if a "rapid cook" time is required, the "rapid cook" button 5 is pressed, for example, within ten seconds of the cook time being set, and this causes a rapid cook light 7 to he flashed and causes a reduced time cooking routine controlled by a microprocessor (not shown) incorporated in the oven to be implemented. The microprocessor uses as a basis for its operation the gas mark setting of the thermostatic gas control 1 and also the cook time set on the display 2 which together afford an indication to the microprocessor of the type of food item to be cooked in the oven. The microprocessor determines which particular cooking routine should be implemented based on the settings on the control panel of the oven and displays a "rapid cook" time on the display 2, which typically is at least half that which was originally set into the control panel.

In FIG. 2 there is depicted a typical control program for the microprocessor referred to in relation to FIG. 1.

In its "normal" operation, the cooking temperature is entered and displayed on the thermostatic gas control 1. The cook time is entered and is displayed on the display 2. After ten seconds the oven power is switched on, the cook time counts down to zero at which time the digital display flashes, a synchronous alarm is sounded and the power is switched off.

If after the cook time has been entered and before ton seconds has elapsed the "rapid cook" button 5 has been pressed, the "rapid cook" light 7 is flashed and the microprocessor selects one of six different cooking routines dependent upon the setting of the cook time and the cooking temperature.

For example, if a cook time of between 0 and 20 minutes has been selected the "low" setting of the microwave heat source is selected and the time and temperature of operation of the oven is selected with the new computed "cook time" being displayed on the display 2. After ten seconds the oven power is switched on, the "rapid cook" light 7 flashes, the displayed cook time counts down to zero at which time the digital display flashes, a synchronous alarm is sounded and the power is switched off.

Similarly, if a cook time of greater than 120 minutes has been selected with a cooking temperature of greater than 300° F., the "high" setting of the microwave heat source is selected and the time and temperature of operation of the oven is selected with the new computed "cook time" being displayed on the display 2.

The six different cooking routines depicted in FIG. 2 are given by way of example only and more or less than six may be used. Also the different routines may make use of more or less than three different microwave settings, and the time during which the microwave source operates in any particular routine may be varied. Similarly, the temperature and time of operation of the convection heat source may be varied.

It is also contemplated that during the operation of a "rapid cook" routine, if the "rapid cook" button 5 is operated, the oven will change from a "rapid cook" routine to a "normal cook" routine, which will depend on the point in the cooking process at which this is done, and will display the revised "cook time" to completion of the cooking process.

The cooking oven which has been described has been found to be very user friendly in that it requires minimal setting requirements which are in keeping with conventional recipes but which enable the advantages of combination ovens to be realised.

It will be appreciated that the combination cooking oven which has been described has been given by way of example only and may be adapted to suit any particular application. For example, the cooking oven may be an electric/microwave combination oven instead of a gas/microwave combination oven.

We claim:

1. A cooking oven, comprising:

a convection heat source and a microwave heat source;

a first control means configured to receive a cooking time selection and a cooking temperature selection;

a second control means configured to receive a reduced time cooking routine selection; and microprocessor means responsive to said reduced time cooking routine selection and configured to:

(a) determine a reduced time cooking routine in response to said cooking time selection and said cooking temperature selection; and (b) control said convection heat source and said microwave heat source in accordance with said reduced time cooking routine.

2. A cooking oven as claimed in claim 1, in which said microprocessor means is effective during said reduced time cooking routine for controlling output temperature and time of operation of said convection heat source and/or microwave power output and time of operation of said microwave heat source.

3. A cooking oven as claimed in claim 1, in which said microprocessor means is responsive to a further operation of said second control means during said reduced time cooking routine and is configured to determine a modified normal cooking routine in response to said further operation of said second control means.

4. A cooking oven as claimed in claim 1, including display means for displaying said cooking time selection and a cook time determined by said microprocessor means.

5. A cooking oven as claimed in claim 1, wherein said convection heat source is a gas burner.

6. A cooking oven as claimed in claim 1, wherein said convection heat source is electrically powered.

7. A cooking oven as claimed in claim 1, wherein said microprocessor means are configured to determine time of operation of said convection heat source and/or determine time of operation of said microwave heat source in response to said cooking time selection and said cooking temperature selection.

8. A cooking oven as claimed in claim 1, wherein said microprocessor means are configured to determine power output of said microwave heat source in response to said cooking time selection and said cooking temperature selection.

9. A cooking oven as claimed in claim 1, wherein said microprocessor means are configured to determine temperature output of said convection heat source in response to said cooking time selection and said cooking temperature selection.

10. A cooking oven as claimed in claim 1, wherein said microprocessor means is configured to determine said reduced time cooking routine when said cooking time selection is a cooking time for a conventional oven and said cooking temperature selection is a cooking temperature for a conventional oven.

11. A cooking oven as claimed in claim 1, wherein said second control means is switching means.

* * * * *